US005531384A

United States Patent [19]

Greene et al.

[11] Patent Number: 5,531,384

[45] Date of Patent: Jul. 2, 1996

[54] SPRAY GUN

[76] Inventors: Robert H. Greene, "Westfield", 5 Prospect Villas, Wetherby, Leeds LS22 4PL, United Kingdom; Andrew I. Cliffe, 1 New Townhouse, Mirfield, West Yorkshire WF14 9PB, United Kingdom; Karl B. Hunziger, Hutzmannweg 14, CH-4202 Duggingen, Switzerland

[21] Appl. No.: 356,170

[22] PCT Filed: Jun. 17, 1993

[86] PCT No.: PCT/GB93/01287

§ 371 Date: Feb. 23, 1995

§ 102(e) Date: Feb. 23, 1995

[87] PCT Pub. No.: WO93/25317

PCT Pub. Date: Dec. 23, 1993

[30] Foreign Application Priority Data

| | | | |
|---|---|---|---|
| Jun. 18, 1992 | [GB] | United Kingdom | 9212974 |
| Feb. 15, 1993 | [GB] | United Kingdom | 9302973 |

[51] Int. Cl.[6] ..... B05B 5/16; B05B 11/04; B05B 5/035

[52] U.S. Cl. ..... 239/708; 239/323; 239/327

[58] Field of Search ..... 239/375, 320, 239/690, 708, 330, 323, 327; 401/141, 102, 176, 179; 222/103, 105, 386.5, 107, 93

[56] References Cited

U.S. PATENT DOCUMENTS

| | | | |
|---|---|---|---|
| 1,865,325 | 6/1932 | McCleod | 401/179 |
| 2,649,999 | 8/1953 | Burch | 222/105 |
| 2,833,444 | 5/1958 | Sherbondy | 222/105 X |
| 2,957,453 | 10/1960 | Eckerle | 401/141 X |
| 3,554,450 | 1/1971 | D'Muhala . | |
| 3,563,258 | 2/1971 | Hechler . | |
| 4,549,243 | 10/1985 | Owen et al. . | |
| 4,556,156 | 12/1985 | Frutin . | |
| 5,032,619 | 7/1991 | Frutin et al. . | |
| 5,220,291 | 6/1993 | Glover et al. . | |
| 5,301,839 | 4/1994 | Eierle et al. | 222/105 X |
| 5,353,962 | 10/1994 | Scholz et al. | 222/105 X |

FOREIGN PATENT DOCUMENTS

| | | | |
|---|---|---|---|
| 0120633 | 10/1984 | European Pat. Off. . | |
| 0163389 | 12/1985 | European Pat. Off. . | |
| 0468736 | 1/1992 | European Pat. Off. . | |
| 0482814 | 4/1992 | European Pat. Off. . | |
| 3721099 | 1/1989 | Germany | 22/105 |
| WO92/12798 | 8/1992 | WIPO . | |
| WO93/03853 | 3/1993 | WIPO . | |

*Primary Examiner*—Kevin P. Weldon
*Attorney, Agent, or Firm*—Larson and Taylor

[57] ABSTRACT

The invention provides an electrostatic spray gun including a replaceable fluid container a nozzle outlet, apparatus for applying high voltage to the liquid and a spring loaded trigger piston for pressurizing the liquid through the outlet. The piston has axially inner and outer parts for forming a lubricant chamber therebetween. The lubricant seals the paint forward of the piston during pressurization and prevents the piston from being locked up during reciprocation.

16 Claims, 4 Drawing Sheets

SPRAY GUN

The invention relates to electrostatic spray guns.

Many patents have been published on such guns, and further our previous patent application GB 92/01490 relates to them; it was filed 12th Aug. 1992 and published as WO 93/03853 on 4th Mar. 1993. Among published patents is EPA 0 482 814, using a flexible sachet as a container for material to be sprayed.

In current work, we have tackled problems of satisfactory sealing of the fluid to be sprayed, within its container, as well as of ready, smooth advance of the piston under low pressure.

The invention provides an electrostatic spray gun comprising a housing with a replaceable fluid container, a forward part from which fluid is to be sprayed, means for expelling fluid from the container, and a high voltage generator for applying electrostatic potential to the fluid to form an electrically charged atomised spray, characterised in that the container is rigid and fluid is expelled from it through a nozzle, for generation of the spray, by a piston within the container under pressure exerted on the piston through a forward part of the generator or otherwise, the piston having axially inner and outer parts with a fluid lubricant seal provided between them.

In the above the invention is characterised by the nature of the container, and the invention may thus alternatively be expressed as a container of fluid for electrostatic spraying, for replaceable reception in an electrostatic spray gun having a housing for the container, a forward part from which the fluid is to be sprayed, means for expelling fluid from the container, and a high voltage generator for applying electrostatic potential to the fluid to form an electrically charged atomised spray, characterised in that the container is rigid and contains a piston disposed to receive when in place in the gun mechanical pressure exerted through a forward part of the generator or otherwise to expel the fluid through a nozzle for generation of the spray, the piston having axially inner and outer parts with a fluid lubricant seal between them.

In one embodiment the inner and outer parts of the piston are separate, assembled with the lubricant between them. Alternatively however the piston is essentially in one piece, a circumferential reservoir for the lubricant separating the axially inner and the axially outer parts. A convenient lubricant, for a gun for paint, is glycerol/starch, providing an expendable reservoir of lubricant both sealing in the paint and preventing it drying round the piston, seizing it, if a container is part used.

In such a construction the electrical path, generator to nozzle, conveniently passes through the fluid to be sprayed, entering the fluid prior to its emergence from the nozzle, via the wall of the container or more conveniently through the piston.

The container may thus be of insulating material, when electrical connection is through a piston of conducting material or at least having an electrical connection through it to the fluid.

Alternatively for example, still providing for the electrical path to be through the fluid to be sprayed, the container, while externally insulating, may be of metal, making the required electrical connection with the generator interiorly, at a position remote from the nozzle, and providing a direct electrical path to the fluid within the container interior. The material of the piston itself is then unimportant.

In a simple and convenient construction, in operation, the container and generator are drawn together to commence spraying, the movement opening a valve for passage of fluid from the nozzle.

Use of such constructions allows very easy front loading of a container and its valve into a gun, or alternatively if required attachment of a complete disposable container/nozzle unit, dispensing with the need for complex conductive paths, without difficulty in securing proper electrical connections. Further where the container is externally insulating there is no risk of shock. Even if the gun is misused, with loading attempted with the generator on, the container cannot discharge the gun through the operator. A range of different units may be provided for a given gun. Specifically for example front loading of the container into the gun simultaneously makes connection to the electrical path from the generator or places the container in a position where a short further movement opening a valve for passage of fluid from the nozzle also makes such contact.

In the following detailed description of an example of an exemplary embodiment of the invention a number of generally applicable features are discussed. In particular, in passing the fluid to the nozzle, it is desirable that alternative flow rates should be available. Conveniently for the purpose pressure is applied to the fluid by a handgrip through the intermediary of a variably pretensionable spring, the force necessary to overcome the pretension determining the minimum force that has to be exerted to actuate the handgrip and thus the minimum pressure applied to the fluid. No variability in the nozzle is then necessary and a simple on/off valve as in aerosols can be used.

Alternatively it may be sufficient that pressure is exerted directly on the container via levers from a hand operated trigger.

The invention is illustrated in the accompanying drawings of embodiments wherein.

Figure 1:
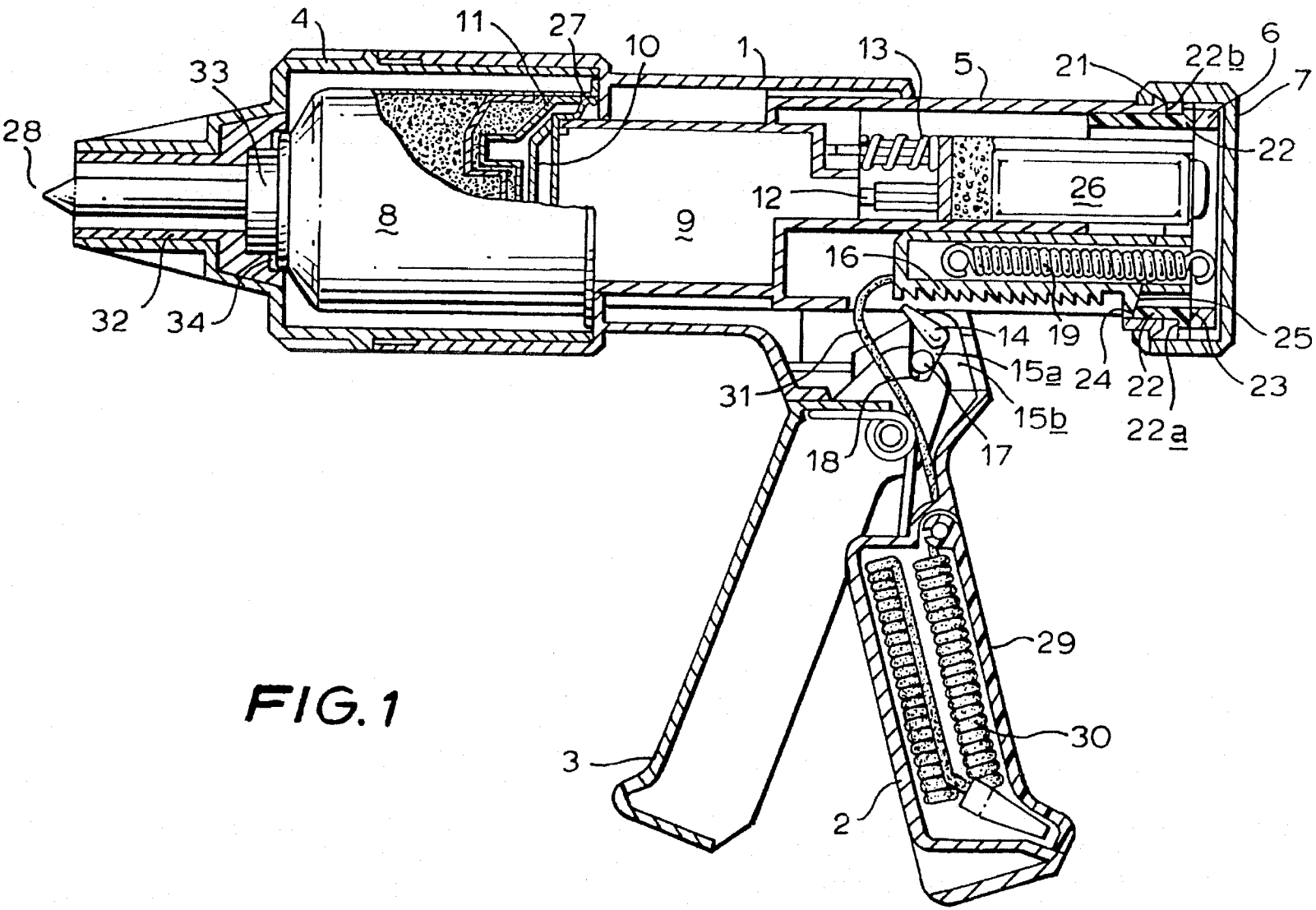
FIG. 1 shows a trigger operated piston-container gun, in detailed part-sectional elevation.
Figure 2:
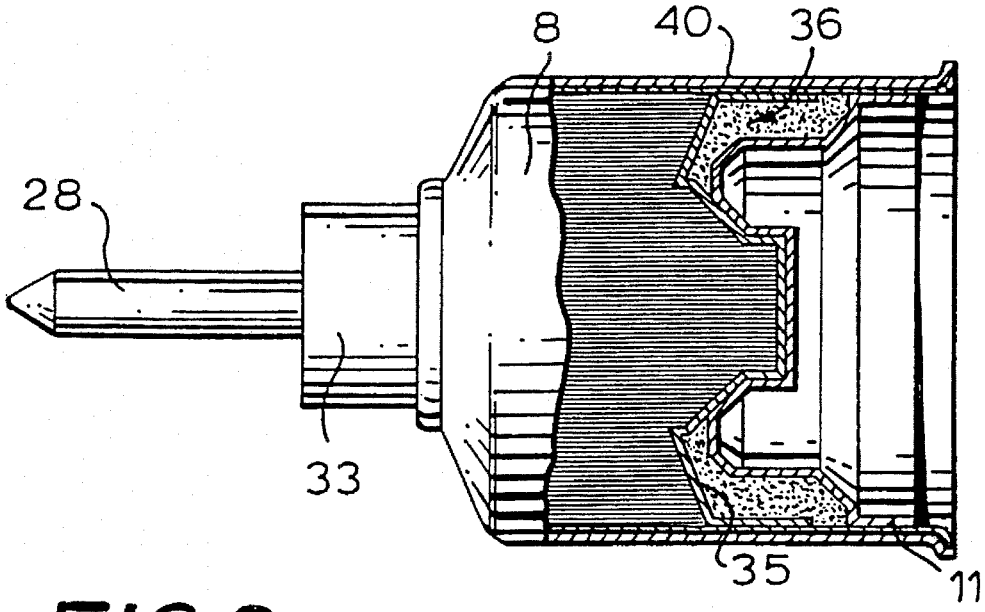
FIG. 2 shows in part sectional elevation a paint container for use with a gun such as that of FIG. 1 (it does not correspond exactly to the container shown in FIG. 1)
Figure 3:
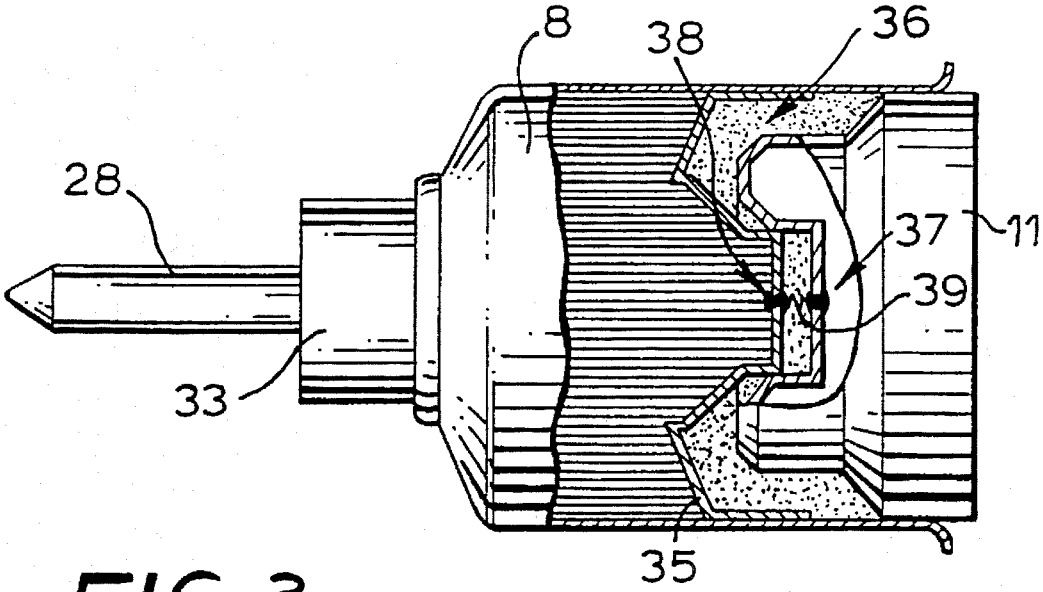
FIG. 3 shows an alternative, similar container.

The following description is of the gun of FIG. 1 and with reference to the containers of FIGS. 2 and 3.

The main parts of the gun are largely moulded in polypropylene and include a main body 1 with integral handle 2 and a trigger 3. The body carries a front cap 4; a generator housing 5; a battery holder 6; and a rear cap 7. The body and front cap together define a housing for a paint container 8. The generator housing slides within the body, urged forward on squeezing of the trigger, and besides accommodating the generator 9 carries a nose 10 to bear on an outer piston 11 within the paint container to expel the paint.

The battery holder in turn slides within the generator housing, but only over a short travel necessary to close a generator switch 12; it is under the control of a return spring 13 that as soon as the trigger is released re-opens the switch.

The operating connection between the trigger and the battery holder and thus the generator housing is through a pawl 14 and ratchet 16. When the trigger is closed the pawl, which is mounted on a small rotatable carrier **15*a* itself mounted on a slide 15*b*, is first moved into engagement with the ratchet by rotation of its carrier by a pin 17 engaged in a slot 18 formed in the end of the trigger. Further movement of the trigger then slides the ratchet and pawl together and extends a regulating spring 19 disposed between and operatively connecting the ratchet and the battery holder. The force needed to do this depends on the setting of the regulating spring as described below, and provides for a variable paint delivery pressure. Paint is then delivered until the work is done and the trigger is released, or until the gap 20 (FIG. 4**) opened between the ratchet and battery carrier has closed, when the trigger may be released and a fresh advance of the ratchet made to continue delivery.

The setting of the variable pretensionable spring 19, which has a small pre-tension in any event, is effected by the rear cap 7. The cap is rotatable and snaps onto the generator housing over a retaining ridge 21 (it is removable for battery replacement). The cap retains, within the generator housing and as a unit slidable over the short travel necessary to open and close the generator switch, first the battery carrier 6, secondly the ratchet 16 and thirdly, sandwiched between them under the tension of the variable pretensionable spring 19, an adjusting "helicoil" 22. The helicoil 22 has a lip 22*a* disposed to engage with a rear face 22*b* on the generator housing, the gap between them representing the travel between the open and closed positions of the generator switch. To provide for the setting of the variable pretensionable spring 19 the helicoil 22 engages the cap by lugs (not shown), so that cap and helicoil 22 turn together but relative axial movement over the required travel is possible. At its plane rear face 23 the helicoil 22 engages part of the battery holder 6, a further part of the holder 6 extending forward within the helicoil 22 to hold the batteries 26. At its helical front face 24 the helicoil 22 engages a sloping face 25 on the ratchet 16. As the variable pretensionable spring 19 is disposed between the ratchet and the battery holder 6, rotation of the cap 7 and with it the helicoil 22 varies the tension of the spring 19. Clockwise rotation of the cap (as seen from the rear of the gun) drives the ratchet forward to increase the pretension and thus the minimum trigger pressure needed to draw the ratchet further forward commence paint delivery. Anti-clockwise rotation allows the variable pretensionable spring 19 to draw the ratchet back as the interposed part of the helicoil 22 narrows, to reduce the pretension again.

Electrically, the gun uses conventional dry batteries 26 and per se known 17 or 34 Kv generator 9. When the switch 12 is in the closed position the electrical path is from the generator through a spring contact 27 to an aluminium container 8, desirably externally insulatingly coated, thence through the paint itself to the nozzle tip 28 (the nozzle is of insulating plastics) where the electrical force applied breaks up the paint into a spray of charged droplets in per se known manner. The spray droplets, controlled in their distribution by a field generated by a urea-based resin shroud 32 in electrical contact with the paint container, travel to the work and discharge to earth. The circuit is completed, according to conditions, either from earth through the operator's hand and the gun structure, the handle of the gun being made, as to a cover 29, from carbon filled plastics, or through an earth lead 30 housed in the handle for attachment to the work (the cover 29 then being closed again) and providing a path back to the generator through an internal lead 31, running in a shrouded path (not shown). The current carried is minute and harmless, and of course access to the electrode 27 during spraying, with a sudden discharge of the generator, is impossible. So likewise, is access during loading, even if tried with the trigger closed.

The paint container 8 has a simple aerosol-type on/off valve 33 which is opened, when the generator nose 10 engages the outer piston 11, by the container moving forward to close a gap 34 between the container body 8 and the shroud 32. Paint passes up the nozzle to emerge at the nozzle tip 28 and form the spray.

The container itself, as already noted, is of aluminium, desirably, externally insulated, and the valve body and nozzle are of insulating plastics. The electrical path is thus through the paint, and electrical connection for spraying is provided simply by the loading of the container, already inserted in the front cap 4, into the gun body 1, the electrode 27 engaging the interior of the open rear end of the container. Within the container is the piston which is made up of the outer part 11 and the inner part 35, both in this example of plastics though they may equally be of metal, a liquid lubricant seal 36 being provided between them. The lubricant, immiscible with the paint, ensures even paint delivery, no excess force being needed to start delivery from a new container or restart it from a partly used one, though if desired, to be sure of the absence of sticking, the piston can be rotated over a short arc within the container in the course of loading. In preparing the container the inner part is inserted, then the lubricant, then the outer part. The parts 11, 35 are pushed down together far enough to ensure that there is lubricant between them and the container walls, and then withdrawn to the position shown. Paint is then filled into the container and the valve and nozzle attached.

The container, spring contact 27 and inner and outer parts 11, 35 shown in FIGS. 1 and 2 have as an alternative the use of a container such as that of FIG. 3. This container, for example of plastics rather than insulatingly-coated aluminium as in FIG. 2 (the coating is at 40), has its inner and outer parts 11, 35 connected by a flexible electrical connection 39 between conductive studs 37, 38 as shown. It connects with a centrally disposed conductive connection on the nose of the generator (not shown), provided instead of the spring contact 27.

Alternatively again, piston parts in telescopic, conducting, engagement with each other after the lubricant has been put in place may be used.

Figure 4:
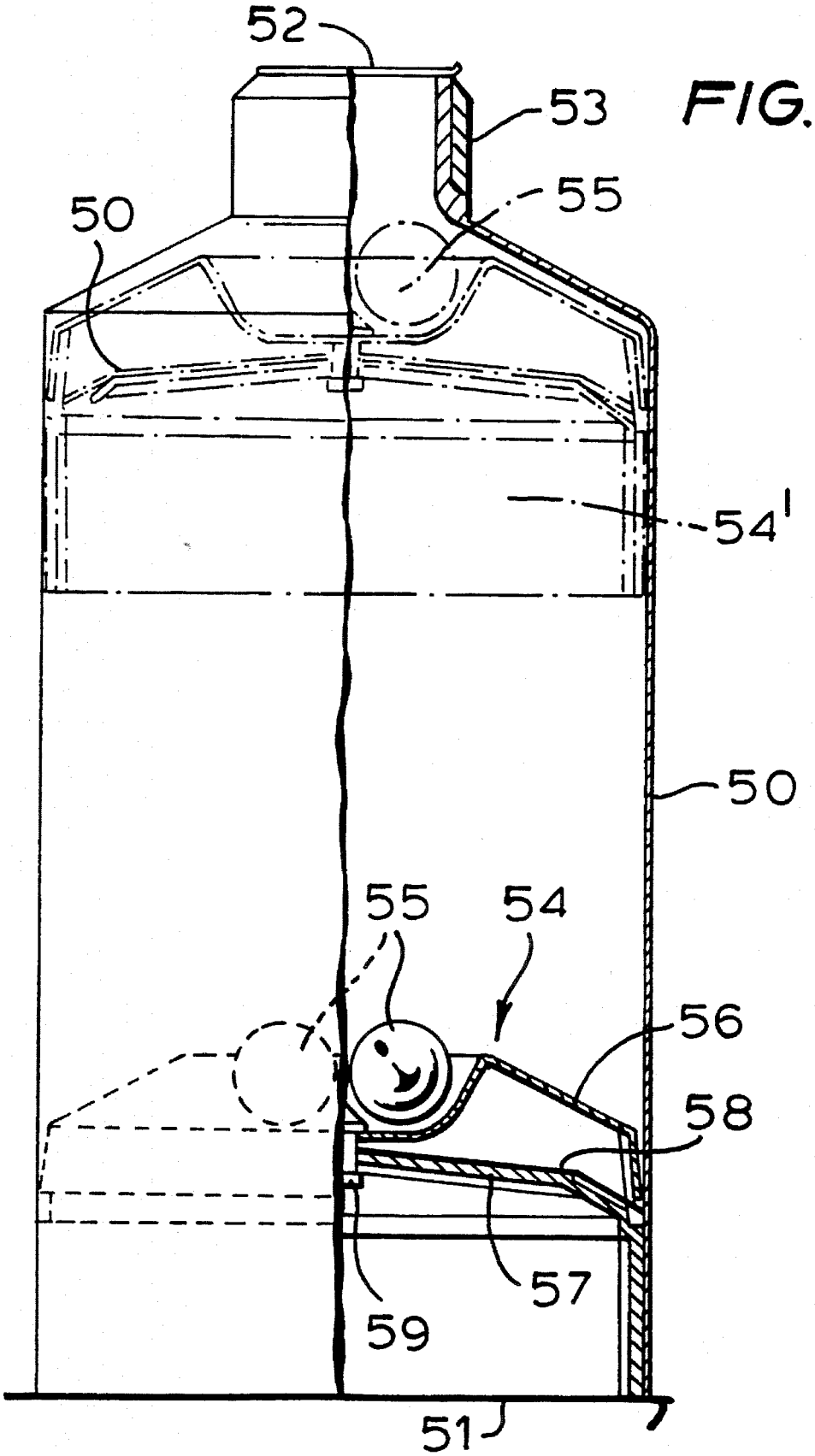
FIG. 4 shows a further, different container.

In FIG. 4 there is shown an aluminium container 50, internally insulatingly coated and holding 105 ml of product to be sprayed. It is closed until use by a tear-off aluminium seal 51 and a similar seal 52 for receipt of a spray nozzle fitting over a neck 53. Inside is a piston generally included at 54 and (container-empty position) 54'. Mixing balls 55 are provided for the product to be sprayed. The piston is double, with an inner part 56 of aluminium and an outer part 57 of plastics, and a mechanical backup seal 58. A conductive stud 59 is provided for contact with the generator nose when the container is inserted in a gun, the electrical path being through it to the aluminium inner part 56 and thence to the product to be sprayed.

Figure 5:
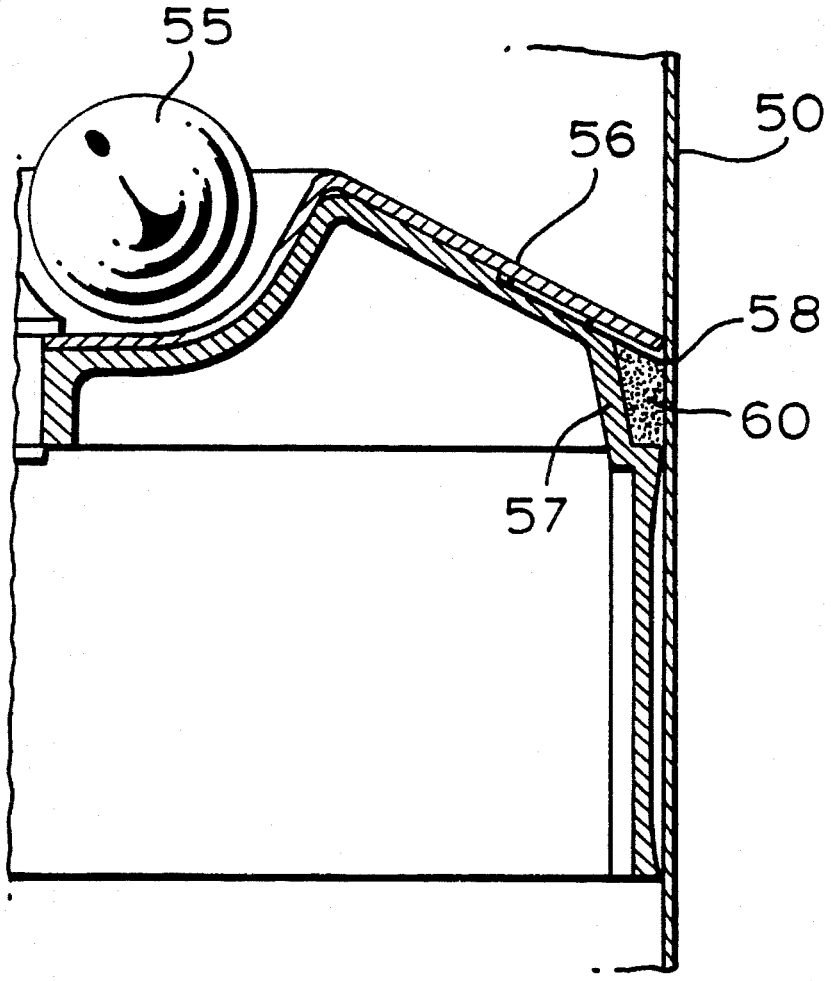
FIG. 5 shows an alternative piston for that container.

The fluid seal is not shown in FIG. 4, but is in the corresponding position to that at 60 in FIG. 5, which is a sectional view on a half-diameter of a similar piston to that shown in FIG. 4. It differs in the inner and outer part 56 and 57 being of closely corresponding shape and thus apposed rather than separated as in FIG. 4, and in the mechanical seal 58 lying between the inner and outer parts at their periphery rather than forming a full disc.

Figure 6:
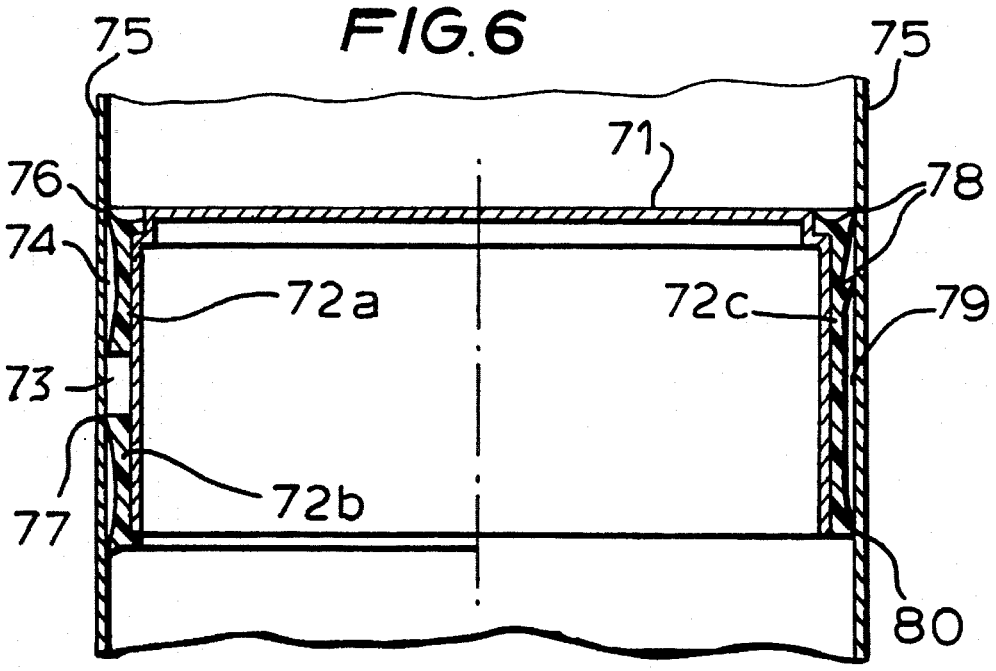
FIG. 6 shows a further piston.

In FIG. 6 there is shown an essentially unitary piston having an aluminium body 71 and alternative designs of plastics ring providing for a lubricant reservoir.

At the left of the figure, two plastics rings or half-sleeves 72*a*, 72*b* provide a main lubricant reservoir at 73 and a subsidiary reservoir at 74, confined by the (schematically indicated) wall 75 of the container. The leading parts of the rings at 76 and 77 are formed as sealing edges, that at 76 separating the paint or other contents of the container from the lubricant and that at 77 ensuring that only a thin film of lubricant is left on the container wall as the piston advances.

At the right of the figure the plastics ring is in the form of a single sleeve 72*c* with dual sealing edges 78 and a shallow, axially extended recess 79 forming the lubricant reservoir. Here the axially outer part of the piston is reduced to the minimum in functional terms, being simply a trailing ridge portion 80 on the sleeve, ensuring that the bulk of the lubricant is carried forward with the piston as it advances.

The design preferred depends on the container contents and on whether a full seal can be provided ensuring that essentially none of the container contents can pass; a larger reservoir as at 73 is desirable if the contents such as paint may not be wholly sealed by the leading edge of the piston.

In all constructions the presence of the expendable reservoir of lubricant achieves consistent, smooth advance of the piston under low actuating pressure, giving consistent flow rates for the container contents. The nature of the lubricant depends on the nature of the material being sprayed, but for paints we have used a liquid lubricant developed from glycerol and starch. A suitable composition consists for example of two parts glycerine to one part maize starch, by weight, reacted at 200°–260° C. for five to thirty five minutes according to the precise grade of starch and the viscosity required. With automotive paint, viscosities of 10000 to 16000 poise have been found suitable, as measured on the Brookfield viscometer at 20° C., type "D" T-bar spindle, 0.5 rpm.

We claim:

1. An electrostatic spray gun comprising a housing with a replaceable fluid container, a forward part from which fluid is to be sprayed, means for expelling fluid from the container, and a high voltage generator for applying electrostatic potential to the fluid to form an electrically charged atomised spray, characterized in that the container is rigid and fluid is expelled from it through a nozzle, for generation of the spray, by a piston within the container the piston having axially inner and outer parts with a fluid lubricant seal provided between them.

2. A gun according to claim 1, wherein the inner and outer parts of the piston are separate parts, assembled with the lubricant between them.

3. A gun according to claim 1, wherein the piston is essentially in one piece, a circumferential reservoir for the lubricant separating the axially inner and the axially outer parts.

4. A gun according to claim 1, for spraying paint, wherein the lubricant is glycerol-starch.

5. A gun according to claim 1, wherein the electrical path from the generator to the nozzle passes through the fluid, entering the fluid prior to its emergence from the nozzle, via the wall of the container or through the piston.

6. A gun according to claim 1 wherein the container is wholly insulating, electrical connection to the fluid being through the piston.

7. A gun as in claim 1 wherein in operation, the container and generator are drawn together to commence spraying, the movement opening a valve for passage of fluid from the nozzle.

8. A gun as claimed in claim 7 wherein front loading of the container into the gun places the container in a position where a short further movement opening a valve for passage of a fluid from the nozzle makes connection to the electrical path from the generator.

9. A gun as in claim 7 wherein front loading of the container into the gun simultaneously makes connection to the electrical path from the generator.

10. A gun as in claim 1 wherein pressure is applied to the container to expel the fluid by a handgrip acting through the intermediary of a variably pretensionable spring, the force necessary to overcome the pretension determining the minimum force that has to be exerted to actuate the handgrip and thus determining the minimum pressure applied to the fluid.

11. A container of fluid for electrostatic spraying, for replaceable reception in an electrostatic spray gun having a housing for the container, a forward part from which the fluid is to be sprayed, means for expelling fluid from the container, and a high voltage generator for applying electrostatic potential to the fluid to form an electrically charged atomised spray, characterized in that the container is rigid and contains a piston disposed to receive when in place in the gun mechanical pressure to expel the fluid through a nozzle for generation of the spray, the piston having axially inner and outer parts with a fluid lubricant seal between them.

12. A fluid container according to claim 11, wherein the inner and outer parts of the piston are separate parts, assembled with the lubricant between them.

13. A fluid container according to claim 12, wherein the piston is essentially in one piece, a circumferential reservoir for the lubricant separating the axially inner and the axially outer parts.

14. A fluid container according to claim 11, containing paint and wherein the lubricant is glycerol-starch.

15. A fluid container according to claim 11, providing for the electrical path from the generator to the nozzle to pass through the fluid, entering the fluid, prior to its emergence from the nozzle, via the wall of the container or through the piston.

16. A fluid container according to claim 11, that is wholly insulating, providing for electrical connection to the fluid through the piston.

* * * * *